US010644411B2

(12) United States Patent
Saberin et al.

(10) Patent No.: US 10,644,411 B2
(45) Date of Patent: May 5, 2020

(54) SCALABLE ANTENNA ARRAY

(71) Applicant: L-3 TECHNOLOGIES, INC., New York, NY (US)

(72) Inventors: Jason Saberin, Simi Valley, CA (US); Frank Cipolla, Simi Valley, CA (US); Sophal Somreth, Simi Valley, CA (US)

(73) Assignee: L3 Technologies, Inc., New York, NY (US)

( * ) Notice: Subject to any disclaimer, the term of this patent is extended or adjusted under 35 U.S.C. 154(b) by 314 days.

(21) Appl. No.: 15/729,827

(22) Filed: Oct. 11, 2017

(65) Prior Publication Data

US 2018/0175509 A1 Jun. 21, 2018

Related U.S. Application Data

(60) Provisional application No. 62/436,220, filed on Dec. 19, 2016.

(51) Int. Cl.

| | |
|---|---|
| ***H01Q 21/24*** | (2006.01) |
| ***H01Q 19/13*** | (2006.01) |
| ***H01Q 3/02*** | (2006.01) |
| ***H01Q 21/06*** | (2006.01) |
| ***H01Q 13/02*** | (2006.01) |
| ***H01Q 15/00*** | (2006.01) |
| ***H01Q 21/00*** | (2006.01) |

(52) U.S. Cl.

CPC ..... *H01Q 21/245* (2013.01); *H01Q 3/02* (2013.01); *H01Q 19/138* (2013.01); *H01Q 21/064* (2013.01); *H01Q 13/0241* (2013.01); *H01Q 15/0013* (2013.01); *H01Q 21/0031* (2013.01)

(58) Field of Classification Search

CPC .. H01Q 3/02; H01Q 3/04; H01Q 3/06; H01Q 3/08; H01Q 3/10; H01Q 13/0241; H01Q 19/138; H01Q 21/064; H01Q 21/245

See application file for complete search history.

(56) References Cited

U.S. PATENT DOCUMENTS

| | | | | |
|---|---|---|---|---|
| 2015/0171515 | A1* | 6/2015 | Milroy | H01Q 3/04 343/756 |
| 2015/0381265 | A1* | 12/2015 | Runyon | H01Q 1/288 455/13.3 |
| 2017/0077610 | A1* | 3/2017 | Bongard | H01Q 21/0025 |

* cited by examiner

*Primary Examiner* — Robert Karacsony
(74) *Attorney, Agent, or Firm* — Workman Nydegger

(57) ABSTRACT

In one scenario, a pillbox array is provided. The pillbox array includes a feed network unit that receives an input wave. The feed network unit includes feed branches for splitting and transmitting the input wave, pillbox reflectors that collimate the input wave, and radiating waveguides for radiating the collimated input wave. The pillbox array further includes a load plate mounted on the feed network unit, where the load plate has load elements placed between the radiating waveguides. This pillbox array also includes a polarizer plate that is mounted on the load plate and the feed network unit. The polarizer plate includes polarizers arranged such that when the polarizer plate is laterally shifted to a first side of the radiating waveguides, a first circular polarization occurs, and when the polarizer plate is laterally shifted to a second side of the radiating waveguides, a second circular polarization occurs.

20 Claims, 6 Drawing Sheets

SCALABLE ANTENNA ARRAY

CROSS-REFERENCE TO RELATED APPLICATIONS

This application claims priority to and the benefit of U.S. Provisional Patent Ser. No. 62/436,220, filed on Dec. 19, 2016, entitled "LOW PROFILE SCALABLE PILLBOX ARRAY," which application is incorporated by reference herein in its entirety.

BACKGROUND

1. The Field of the Invention

A scalable sub-array of multiple pillbox feeds and a corporate feed network form a larger array of switchable polarization elements.

2. The Relevant Technology

Modern electronic devices use many different types of antennas to send and receive data signals. Some of these antennas include passive arrays for strengthening signal reception. Passive arrays are often difficult structures to design in complex systems. The arrays are often not easily scalable and may have intricate feed systems that increase design and manufacturing complexity. These designs are even more complex when there is a requirement for dual circular polarization. Current antennas that implement passive arrays, such as pillbox antennas, are limited by either their aperture size or lack of independent polarization control. In addition, current pillbox antennas are not able to meet strict low profile airborne requirements.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

In one embodiment, a pillbox array is provided. The pillbox array includes a feed network unit that is designed to receive an input wave. The feed network unit includes feed branches that split and transmit the input wave. The feed network unit also includes pillbox reflectors that collimate the input wave to produce a wave of equal phase front. Still further, the feed network unit includes radiating waveguides for radiating the collimated input wave. The pillbox array further includes a load plate mounted on the feed network unit. The load plate has multiple load elements that are placed between the radiating waveguides.

This pillbox array also includes a polarizer plate that is mounted on the load plate and the feed network unit. The polarizer plate includes polarizers arranged such that when the polarizer plate is laterally shifted, the polarizers are located on a first side of the radiating waveguides and a first circular polarization occurs. When the polarizer plate is laterally shifted so that the polarizers are located on a second side of the radiating waveguides, a second different circular polarization occurs.

In another embodiment, a pillbox array is provided that includes an input feed network and multiple scalable pillbox subarrays. At least some of the scalable subarrays are configured to receive input waves from the input feed network. The pillbox subarrays include pillbox reflectors for collimating the input waves thereby producing a collimated wave of equal phase front. The pillbox array also includes multiple radiating waveguides for radiating the collimated wave, as well as load elements that are positioned between the radiating waveguides. Moreover, the pillbox array includes multiple polarizers mounted on the load elements which, when shifted to a first position on a first side of the radiating waveguides, polarize the collimated wave with a first circular polarization, and when shifted to a second position on a second side of the radiating waveguides, polarize the collimated wave with a second circular polarization.

In another embodiment, a method is provided for polarizing a signal. The method includes a feed network unit of a pillbox array receiving an input wave. The feed network unit includes various elements including feed branches for splitting and transmitting the input wave, pillbox reflectors that collimate the input wave, and radiating waveguides for radiating the collimated input wave. The method next includes either determining that a first circular polarization is to be applied to the collimated input wave and laterally moving a polarizer plate such that the polarizers on the polarizer plate are moved to a first side of the plurality of radiating waveguides, causing the first circular polarization to occur or, alternatively, determining that a second circular polarization is to be applied to the collimated input wave and laterally moving the polarizer plate such that the polarizers on the polarizer plate are moved to a second side of the plurality of radiating waveguides, causing the second circular polarization to occur.

These and other objects and features of the present invention will become more fully apparent from the following description and appended claims, or may be learned by the practice of the invention as set forth hereinafter.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

Figure 1A:
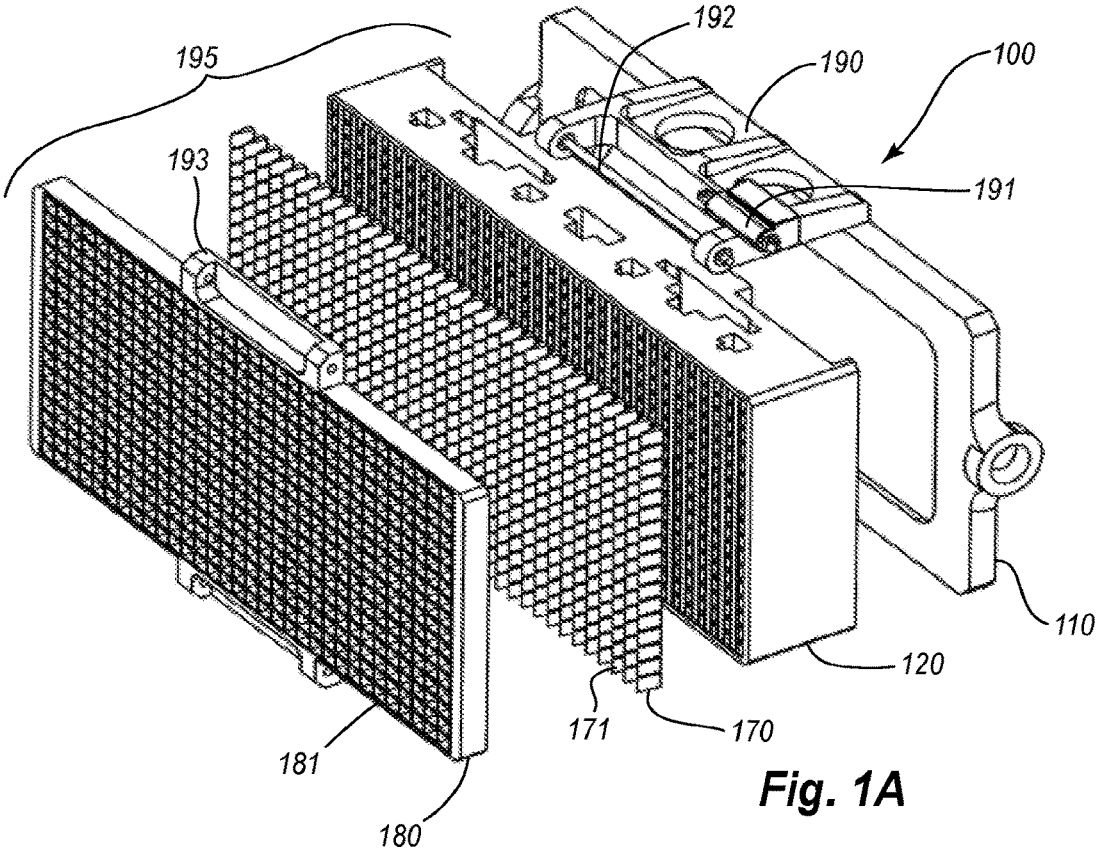
FIG. 1A illustrates a front perspective view of a pillbox array according to the embodiments disclosed herein.

In the following detailed description, reference is made to the accompanying drawings, which form a part hereof. In the drawings, similar symbols typically identify similar components, unless context dictates otherwise. The embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein. It will also be understood that any reference to a first, second, etc. element in the claims or in the detailed description, is not meant to imply numerical sequence, but is meant to distinguish one element from another unless explicitly noted as implying numerical sequence.

Before describing the present disclosure in detail, it is to be understood that this disclosure is not limited to the specific parameters of the particularly exemplified systems, apparatus, assemblies, products, devices, kits, methods, and/or processes, which may, of course, vary. It is also to be understood that much, if not all of the terminology used herein is only for the purpose of describing particular embodiments of the present disclosure, and is not necessarily intended to limit the scope of the disclosure in any particular manner. Thus, while the present disclosure will be described in detail with reference to specific configurations, embodiments, and/or implementations thereof, the descriptions are illustrative only and are not to be construed as limiting the scope of the claimed invention.

Various aspects of the present disclosure, including devices, systems, methods, etc., may be illustrated with reference to one or more exemplary embodiments or implementations. As used herein, the terms "exemplary embodiment" and/or "exemplary implementation" means "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

Furthermore, unless defined otherwise, all technical and scientific terms used herein have the same meaning as commonly understood by one of ordinary skill in the art to which the present disclosure pertains. While a number of methods, materials, components, etc. similar or equivalent to those described herein can be used in the practice of the present disclosure, only certain exemplary methods, materials, components, etc. are described herein.

It will be noted that, as used in this specification and the appended claims, the singular forms "a," "an" and "the" include plural referents unless the content clearly dictates otherwise. Thus, for example, reference to a "column" includes one, two, or more columns. Similarly, reference to a plurality of referents should be interpreted as comprising a single referent and/or a plurality of referents unless the content and/or context clearly dictate otherwise. Thus, reference to "columns" does not necessarily require a plurality of such columns. Instead, it will be appreciated that independent of conjugation; one or more columns are contemplated herein.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct association between two components or, where appropriate, an indirect association with one another through intervening or intermediate components. In contrast, when a component is referred to as being "directly coupled", "directly attached", "directly connected," and/or "directly joined" to another component, no intervening elements are present or contemplated.

Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "forward," "rear," "left," "right," "up," "down," "upper," "lower," "inner," "outer," "internal," "external," "interior," "exterior," "anterior," "posterior," "proximal," "distal," and the like can be used only for convenience and/or solely to indicate relative directions and/or orientations and may not otherwise be intended to limit the scope of the disclosure, including the specification, invention, and/or claims. Accordingly, such directional and/or arbitrary terms are not to be construed as necessarily requiring a specific order or position.

To facilitate understanding, like reference numerals have been used, where possible, to designate like elements common to the figures. Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number.

In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where two or more values, or a range of values (e.g., less than, greater than, at least, and/or up to a certain value, and/or between two recited values) is disclosed or recited, any specific value or range of values falling within the disclosed values or range of values is likewise disclosed and contemplated herein. Thus, disclosure of an illustrative measurement or distance less than or equal to about 10 units or between 0 and 10 units includes, illustratively, a specific disclosure of: (i) a measurement of 9 units, 5 units, 1 units, or any other value between 0 and 10 units, including 0 units and/or 10 units; and/or (ii) a measurement between 9 units and 1 units, between 8 units and 2 units, between 6 units and 4 units, and/or any other range of values between 0 and 10 units.

Various modifications can be made to the illustrated embodiments without departing from the spirit and scope of the invention as defined by the claims. Thus, while various aspects and embodiments have been disclosed herein, other aspects and embodiments are contemplated. It is also noted that systems, apparatus, assemblies, products, devices, kits, methods, and/or processes, according to certain embodiments of the present disclosure may include, incorporate, or otherwise comprise properties, features, components, members, and/or elements described in other embodiments disclosed and/or described herein. Thus, reference to a specific feature in relation to one embodiment should not be construed as being limited to applications only within said embodiment.

The headings used herein are for organizational purposes only and are not meant to be used to limit the scope of the description or the claims.

A pillbox array is described herein. As described above, the pillbox array includes a feed network unit that is designed to receive an input wave. The feed network unit includes feed branches that split and transmit the input wave. The feed network unit also includes pillbox reflectors that collimate the input wave to produce a wave of equal phase front. Still further, the feed network unit includes radiating waveguides for radiating the collimated input wave. The pillbox array further includes a load plate mounted on the feed network unit. The load plate has multiple load elements that are placed between the radiating waveguides. This pillbox array also includes a polarizer plate that is mounted on the load plate and the feed network unit. The polarizer plate includes polarizers arranged such that when the polarizer plate is laterally shifted, the polarizers are located on a first side of the radiating waveguides and a first circular polarization occurs. When the polarizer plate is laterally shifted so that the polarizers are located on a second side of the radiating waveguides, a second different circular polarization occurs.

In at least some embodiments herein, a passive pillbox array is utilized as the radiating structure for an antenna array assembly. The pillbox array is configured to provide instantaneous wideband beam collimation to a power-combining or power-splitting network. Within such a network, a combiner or splitter includes multiple parallel plate waveguides that support a transverse electromagnetic mode (TEM). This ensures the continuity of the amplitude taper and phase front of the wave traveling through the plates. In order to achieve switchable dual circular polarization, the radiating portion of the aperture is branched out to square waveguide septum polarizers or a polarizing FSS, as will be described further below with reference to the Figures. The antenna beam of the array may be steered in elevation by tilting the entire radiation structure on a mechanically gimbaled platform, by moving the primary feed point across the pillbox focal point, or by electronically changing feed amplitudes across the pillbox.

The pillbox antenna may be fed through a waveguide for transmit and receive purposes. In one example array, the feed is initially split into four branches that are fed into four sub-array pillboxes. However, a multitude of pillbox feed structures can be used for larger arrays, if needed. Each pillbox is fed by a horn that launches a wideband spherical wave. The spherical wave then travels through a dual-layer parabolic pillbox that in turn collimates the beam. This creates a plane wave with a tapered amplitude and equal phase front. This technique ensures easy and inexpensive wideband array radiation pattern optimization.

Furthermore, the ability to beam steer the aperture without an elevation tilt may be achieved by moving the feeding horn physically or electronically laterally along the focal axis of the pillbox antenna, thus lowering the profile of the antenna even further. The polarization switching described herein may be accomplished through mechanical actuation of septum polarizers with respect to the parallel plate splitting network, sliding the aperture laterally in order to switch the polarization from a first polarization to a second, different polarization. Each of the above embodiments will be described in greater detail below with regard to the Figures. It will be noted that the pillbox arrays disclosed herein are passive devices and therefore follow all laws of reciprocity. In other words, while such terms as "receive an input wave" or "transmit an input wave" may be used, the embodiments disclosed herein are able to operate equally well in either transmit or receive mode.

Figure 1B:
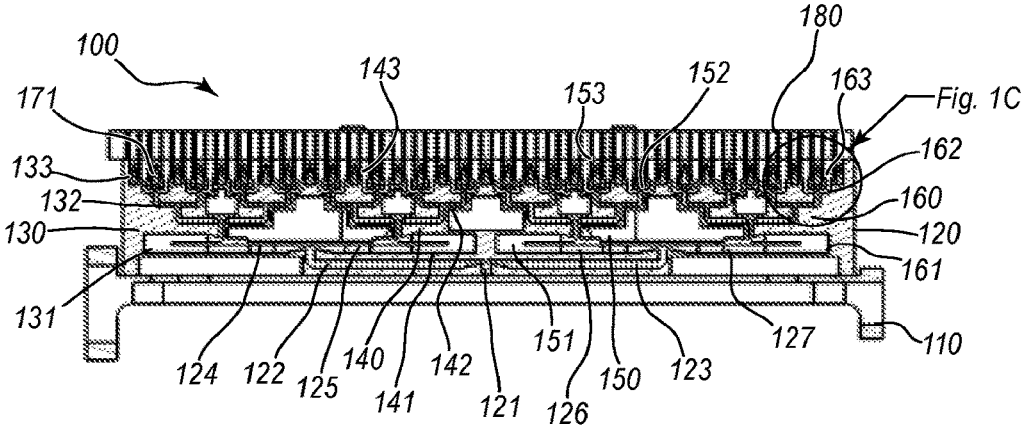
FIG. 1B illustrates a top view of the pillbox array.
Figure 4A:
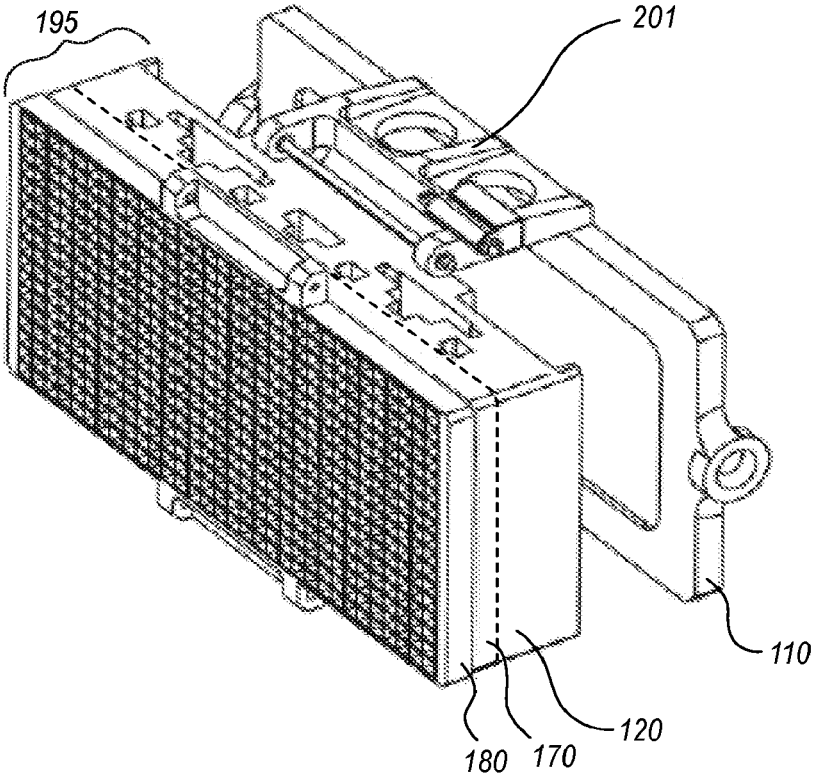
FIGS. 4A-4B illustrate embodiments of a pillbox array being vertically tilted from an initial down position to a second, tilted position.
Figure 4B:
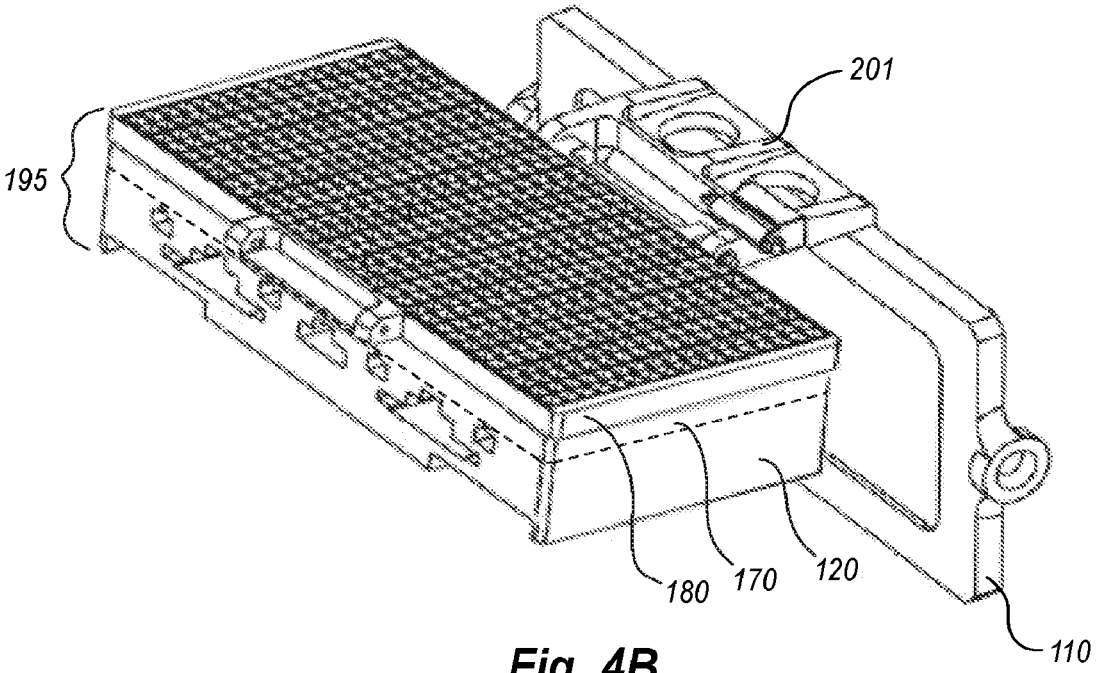

Attention is now given to FIGS. 1A and 1B, which illustrate two views of an example pillbox array 100 in accordance with the embodiments disclosed herein. It will be noted that the pillbox array 100 may be used as a transmit array, a receive array or both a transmit and a receive array. As shown in FIGS. 1A and 1B, the pillbox array 100 may include a mechanical assembly 110 that is used to mount the other elements of the pillbox array 100. The mechanical assembly 110 may also include mechanical elements that allow the pillbox array 100 to be moved in elevation and/or azimuth and/or tilted as needed (as generally shown in FIGS. 4A and 4B). In one embodiment, the mechanical assembly 110 may include a support structure 190 with a hinge 192 that attaches to a corresponding hinge piece 193 on the polarizer plate 180. The hinge 192 or other mechanical element allows the combined structure 195 (that includes polarizer plate 180, load plate 170, and feed network unit 120) to be moved in elevation or tilted.

Figure 5A:
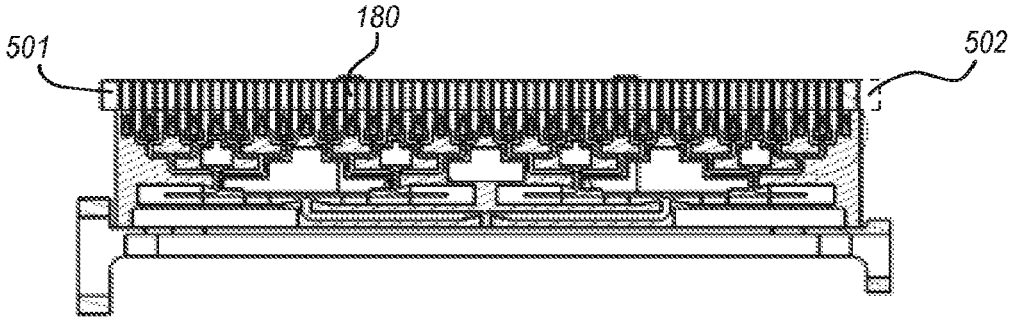
FIGS. 5A-5B illustrate an embodiment of a pillbox array in which a polarizer plate is shifted from a first position to a second position to cause variations in polarization.
Figure 5B:
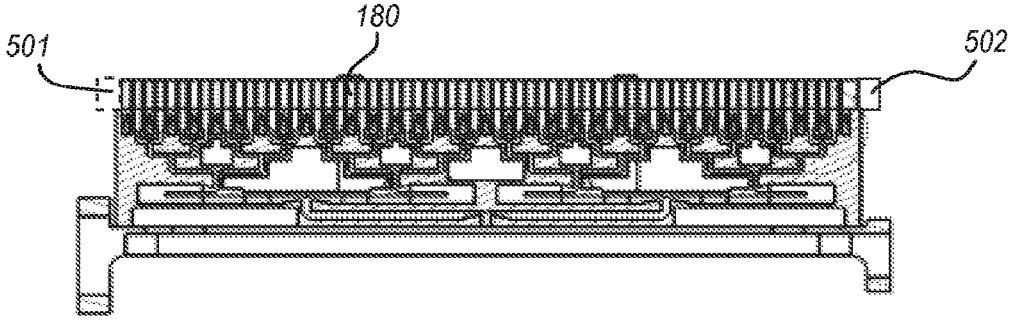

In some cases, the support structure 190 includes an actuator 191 that is configured to laterally move a plate of polarizers from a first position to a second position, as generally shown in FIGS. 5A-5B and as will be explained in more detail below. Accordingly, the mechanical assembly 110 may represent any combination of mechanical and/or electromechanical components or elements that facilitate movement of the combined structure 195, either vertically or laterally.

As shown in FIGS. 1A and 1B, the pillbox array 100 may include a feed network unit 120 that is mounted on the mechanical assembly 110. The feed network 120 will now be described in more detail with particular reference to FIG. 1B. The feed network 120 of FIG. 1B includes an input port 121 for receiving an input waveform or signal from a horn antenna (196 of FIG. 1D) that provides the input waveform to the pillbox array 100. The input port 121 may then split into two feed branches 122 and 123. The feed branch 122 may then be further split into feed branches 124 and 125, and the feed branch 123 may be further split into feed branches 126 and 127. It will be recognized that while four feed branches are used in the embodiment of FIG. 1B (124-127), more or fewer feed branches may be used in the pillbox array 100.

In some embodiments, a horn antenna 196 provides the input waveform 197 to the input port 121. This input waveform 197 may then be split into the various feed branches. In some embodiments, only a single horn antenna will be used, while in other embodiments, there may be more than one horn that provides an input waveform to the pillbox array 100. In those embodiments that include more than one horn for providing the input waveform, a separate horn may be used to provide an input waveform to each of the feed branches 124, 125, 126, and 127. In such cases, each horn may provide the input waveform to the feed branch they are connected to at the same time. Because the input waveforms are received at each feed branch simultaneously, the polarizers on the polarizer plate 180 can more effectively polarize the input waveforms to achieve dual polarization. This will be described in greater detail below.

As shown in FIG. 1B, the feed network 120 may also include four separate pillbox subarrays 130, 140, 150, and 160 that are each fed by one of the feed branches 124-127. For example, the pillbox subarray 130 may be fed by the feed branch 124. The pillbox array 130 may include a first pillbox reflector 131. As is understood by one of skill in the art, a pillbox reflector may be a generally parabolic-shaped reflector. The pillbox reflector 131 (along with the other pillbox reflectors 141, 151 and 161) is designed to collimate the input wave from the antenna horn. The collimation produces a wave of equal phase front which is then fed from the reflectors to the feed networks. In some embodiments, the pillbox reflectors 131, 141, 151, and 161 may be dual-layer or triple layer pillbox reflectors.

Coupled to each pillbox reflector is a feed network (e.g. 132, 142, 152 and 162). As shown in FIG. 1B, the feed network 132 includes various splitters that split the feed path from the pillbox reflector 131 into multiple branches. It is noted that these branches are not labeled in FIG. 1B so as to not have too many reference numerals in the picture. For example, a feed path from the pillbox reflector 131 splits into two feed branches, which then split into four feed branches, and finally split into eight feed branches. The feed network 132 (and the feed networks 142, 152, and 162) may be comprised of various parallel plate waveguides (e.g. 133) that support a transverse electromagnetic mode (TEM) which ensures continuity of amplitude taper and equal phase front of the waves traveling through the feed networks.

Each of the eight feed branches may then feed eight waveguides or radiating slots 133. The waveguides 133 represent the output ports for the pillbox subarray 130, and are configured to radiate the output wave. These may be any type of radiating slot or waveguide (e.g. 133, 143, 153 or 163) as needed given the transmit and receive characteristics (e.g. frequency) that are desired when operating the passive pillbox array 100. The radiating slots may thus be smaller or larger as needed for any given implementation.

Although it is shown that the feed network 132 of the pillbox subarray 130 ultimately splits into eight branches and includes eight waveguides 133, this need not always be the case. Thus, in other embodiments different numbers of branches and/or waveguides may be used as circumstances warrant. Accordingly, the embodiments disclosed herein are not limited to any particular number of feed branches for the feed network 132 or for any number of waveguides 133.

The pillbox subarray 140 may include pillbox reflector 141, which is fed by the feed branch 125. Coupled to the pillbox reflector 141 is a feed network 142. As shown in FIG. 1B, the feed network 142 includes various splitters that split the feed path from the pillbox reflector 141 into multiple branches. For example, as noted above with regard to feed network 132, a feed path from the pillbox reflector 141 also splits into two feed branches, which then split into four feed branches, and finally split into eight feed branches. Each of the eight feed branches may then feed eight waveguides or radiating slots 143. The waveguides 143 represent the output ports for the pillbox subarray 140 and are configured to radiate the output wave.

Similar to the pillbox subarray 140, the pillbox subarrays 150 and 160 each include pillbox reflectors 151 and 161 that are fed by the feed branches 126 and 127, respectively. Coupled to the pillbox reflectors 151/161 are feed networks 152/162. As shown in FIG. 1B, the feed networks 152/162 includes various splitters that split the feed path from the pillbox reflectors 151/161 into multiple branches. Each feed branch then feeds waveguides or radiating slots 153/163. The waveguides 153/163 represent the output ports for the pillbox subarrays 150/160 and are configured to radiate the output wave. Similar features may be included in other pillbox subarrays as desired.

It will be appreciated that just like the pillbox subarray 130, the pillbox subarrays 140, 150, and 160 are not limited to any number of feed branches and/or waveguides. Further, the waveguides 143, 153, and 163 may be any type of waveguide given the transmit and receive characteristics that are desired when operating the passive pillbox array 100. It will also be noted that the combination of the waveguides 133, 143, 153, and 163 is designed to form the aperture or radiating portion for the pillbox array 100.

In some cases, many more pillbox subarrays may be used in a given pillbox array. While the embodiment of FIG. 1B illustrates four pillbox subarrays, the embodiments disclosed herein provide for a scalable pillbox array that is able to have any number of additional pillbox subarrays as circumstances warrant. Accordingly, in some embodiments, size requirements or operating requirements may specify that additional pillbox subarrays are to be added to the passive pillbox array 100. In this way, the pillbox array 100 may be configured for different operational uses in environments that have varying dimensional constraints. This may be especially beneficial for low-profile antenna arrays that are designed to fit in constrained spaces.

Figure 1C:
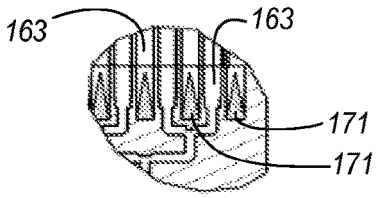
FIG. 1C illustrates a close-up of a portion of FIG. 1B.

As illustrated in FIGS. 1A and 1B, the pillbox array 100 includes a load plate or layer 170. The load plate 170 may include substantially any number of load elements 171. The load elements 171 may be constructed of various materials and may be formed in various shapes in order to meet the operational needs of a given situation. For instance, as shown in FIG. 1C, a detailed portion of FIG. 1B illustrates that the load elements 171 may be pyramid-shaped or triangle-shaped. However, it will be noted that in other embodiments, the load elements 171 may be other shapes. The different shapes may affect how the load for the polarizers is distributed. Accordingly, the embodiments disclosed herein are not limited by any shape of the load elements 171.

As further shown in FIGS. 1B and 1C, the load elements 171 may be placed between the waveguides 163 that are output ports of the array. For example, FIG. 1C shows that load elements 171 are placed between the waveguides 163. The load elements 171 may be sized appropriately so as to fit between the waveguides 163. The load elements 171 provide a load for the polarizers (e.g. 181), thereby facilitating polarization of the input waveform. The pillbox array 100 includes a polarizer plate 180 that is configured to sit on top of the feed network unit 120 and the load plate 170. As shown in FIGS. 1A and 1B, the polarizer plate 180 may include multiple polarizers 181 that are configured to provide dual circular polarization.

Figure 2A:
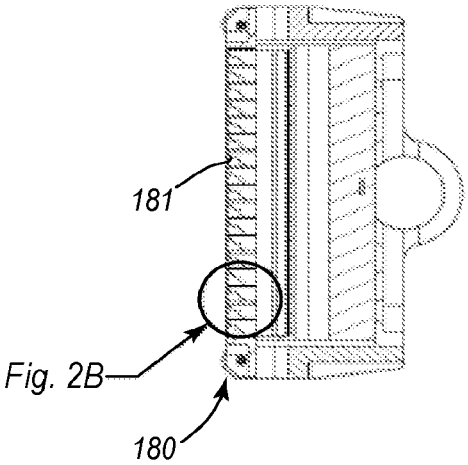
FIGS. 2A and 2B illustrate an array of step septum polarizers according to the embodiments disclosed herein.
Figure 2B:
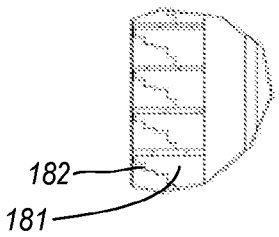

FIGS. 2A and 2B illustrate an embodiment of the polarizer plate 180 and the polarizers 181. As illustrated, the polarizers 181 may be step septum polarizers. For example, as shown in FIG. 2B, each of the step septum polarizers 181 includes steps 182 that are configured to cause the output wave to be spun in a circular fashion. Of course, it will be appreciated that other polarizers that are capable of causing the wave to spin in a circular fashion may also be used as circumstance warrant. Accordingly, the embodiments disclosed herein are not limited by any specific type of polarizers 181. Moreover, each polarizer plate may include any number of polarizers 181, and each polarizer may have any number of steps.

The operation of the passive pillbox array 100 will now be explained with particular reference to the pillbox subarray 130. It will be appreciated, however, that the operation of the pillbox subarrays 140, 150, and 160 may be the same as that of the pillbox subarray 130. In operation, a horn (196 of FIG. 1D) provides a wideband spherical wave into the port 121. The spherical wave is split into the feed branches 122 and 123 and then fed into the feed branches 125-127 as previously described. In this manner, the wideband spherical wave arrives at the pillbox reflector 131 via the feed branch 125.

Upon arriving at the pillbox reflector 131, the spherical wave then travels through the reflector. As will be appreciated by one of skill in the art, the pillbox reflector 131 collimates the spherical wave, thus creating a plane wave having a substantially equal phase front. This plane wave may then be split multiple times as it travels through the various branches of the feed network 132 until the various split portions of the wave reach waveguides 133. In embodiments where the polarizer plate 180 is not present, the wave that was output by the waveguides 133 would be linearly polarized. However, as the linear wave front travels over the steps 182 of the step septum polarizers 181, the linear wave front is spun in a circular manner to create a circular polarization.

As will be appreciated by one of skill in the art, polarizers may cause two different types of circular polarization: "right hand" circular polarization and "left hand" circular polarization. The type of circular polarization produced by the polarizers depends on which side of the step septum polarizer the propagating wave exists. For example, if the wave is on the right side of the polarizer then "right hand" circular polarization occurs, and if the wave is on the left side of the polarizer, then "left hand" circular polarization occurs. It will also be appreciated that in order for the step septum polarizer to work, a load is needed on the other side of the polarizer, opposite of where the wave is. Thus, in the embodiments disclosed herein, the load elements 171 act as the load for the step septum polarizers 181. The load elements 171 are placed on each side of the waveguides 133 and thus are available to act as a load for the step septum polarizers regardless of which side of the waveguides 133 the polarizer is on.

Advantageously, the embodiments disclosed herein provide a way to efficiently switch the polarization between "right hand" circular polarization and "left hand" circular polarization as needed. For example, if "right hand" circular polarization is desired, then a portion of the mechanical array 110 may laterally move the polarizer plate 180 to the right so that the step septum polarizers 181 are located on the right side of the waveguides 133. Since the wave front at the waveguides 133 would then be to the right of the step septum polarizers and a load element 171 would be to the left side, "right hand" circular polarization would occur and a "right hand" circular polarized wave would be radiated from pillbox array 100.

In like manner, if "left hand" circular polarization is needed, then a portion of the mechanical array 110 may laterally move the polarizer plate 180 to the left such that the step septum polarizers 181 are located on the left side of the waveguides 133. Since the wave front at the waveguides 133 would then be on the left of the step septum polarizers and a load element 171 would be on the right side, "left hand" circular polarization would occur and a "left hand" circular polarized wave would be radiated from pillbox array 100. Accordingly, by switching the polarizer plate 180 from left to right as needed, the passive pillbox array 100 is able to function as a remotely switchable dual circular polarization array antenna, and the pillbox array is able to achieve the various operational advantages achieved from efficiently switching circular polarization. This left to right switching is generally shown in FIGS. 5A and 5B, as will be discussed further below.

In one specific embodiment, a pillbox array 100 is described that includes a feed network unit (e.g. 132, 142, 152 or 162 of FIG. 1B). The feed network unit is configured to receive an input wave at the input port 121. The input wave may be substantially any type of wave or transmission signal that is to be propagated through the pillbox array 100. The feed network unit 132 includes multiple elements including feed branches 122-127 for splitting and transmitting the input wave. For instance, a signal is received at the input port 121 (e.g. from antenna horn 196), and is split to travel down feed branches 122 and 123. The signal that travels down feed branch 122 is then split again into feed branches 124 and 125. The input signal (now split four ways) is reflected at pillbox reflectors 131, 141, 151 and 161 to the respective feed networks 132, 142, 152 and 162. Thus, in this manner, feed branch 124 relays the signal into feed network 132, feed branch 125 relays the signal into feed network 142, and so on. Each reflector collimates its portion of the split input wave. This produces a wave of equal phase front going into the respective feed networks.

Each feed network also includes a plurality of radiating waveguides (133, 143, 153 or 163) for radiating each split portion of the collimated input wave. A load plate 170 may be mounted on the feed network unit 120 (see FIG. 1A). The load plate includes multiple load elements 171 that are placed between the radiating waveguides. A polarizer plate 180 is also included in the pillbox array 100 that is mounted on the load plate 170, which is in turn mounted on the feed network unit 120. The combined structural unit 195 includes the polarizer plate 180, the load plate 170 and the feed network unit 120. The combined structure 195 may be moved relative to the mechanical assembly 110 to steer the antenna output beam.

As shown in FIGS. 3A-3C and 4A and 4B, an antenna beam can be steered by tilting the pillbox array. In FIG. 4A, the combined structure 195 including polarizer plate 180, load plate 170 and feed network unit 120 are in a default or down position relative to the mechanical assembly 110. In corresponding FIG. 3A, the beam output by the pillbox array (i.e. beam 301) is vertically centered. In FIG. 4B, the combined structure 195 is tilted upwards on a mechanically gimbaled platform (i.e. 110 and 201). The platform includes a hinge mechanism 201 that connects the combined structure 195 to the mechanical platform 110. In this manner, the combined structure 195 may be tilted to substantially any angle to steer the output antenna beam in a desired direction. As the combined structure 195 is tilted from the initial position in FIG. 4A to the final position in FIG. 4B, the beam will be steered in an increasingly angled manner, as shown in progressive FIGS. 3B and 3C.

Figure 1D:
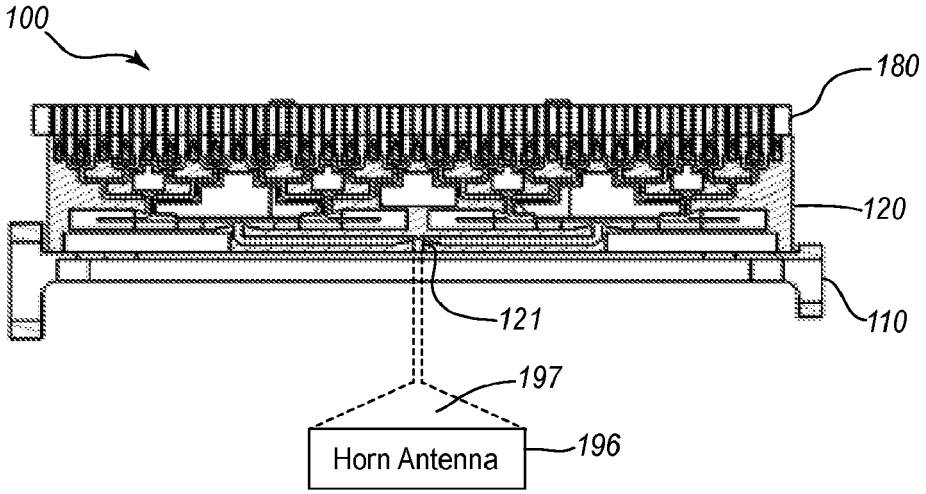
FIG. 1D illustrates a top view of the pillbox array which additionally includes a horn antenna.
Figure 3C:
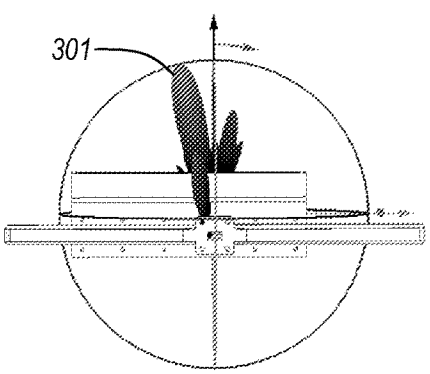
FIGS. 3A-3C illustrate a transmission beam being steered from a centered position to increasingly angled positions according to the embodiments disclosed herein.
Figure 3B:
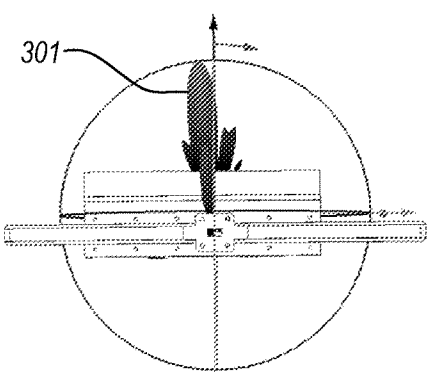
Figure 3A:
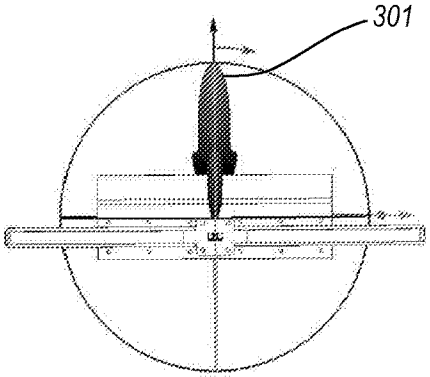

Additionally or alternatively, the output antenna beam may be steered by moving a primary feed horn (or other wave source) across a defined focal axis associated with the pillbox array. In one example, the feed horn 196 of FIG. 1D is moved laterally across a focal axis relative to the input port 121. In other cases, the antenna beam may be steered by electronically changing feed input wave amplitudes across the feed network unit 120 of the pillbox 100. As shown in FIGS. 3A-3C, the beam 301 may be steered from a centered position in FIG. 3A, to a more angled position in FIG. 3B, to a still more angled position in FIG. 3C. This may be accomplished by modulating input wave amplitudes at the antenna horn 196. Thus, using a variety of different techniques, the output beam may be steered in substantially any direction.

Returning now to FIG. 1A and additionally to FIGS. 2A and 2B, the polarizer plate 180 includes multiple polarizers 181 that, as explained above, polarize the output signal in a "right hand" circular polarization or a "left hand" circular polarization. The polarizer plate 180 may be laterally shifted so that the polarizers are located on one side of the radiating waveguides, resulting in a desired polarization (e.g. "left hand" circular polarization). Or, the polarizer plate 180 may be laterally shifted so that the polarizers are located on another side of the radiating waveguides, resulting in a different (e.g. "right hand" circular) polarization.

This is shown in FIGS. 5A and 5B, where the polarization plate 180 is in a first position represented by 501. As can be seen, the polarization plate 180 hangs over the left side edge of the load plate. When actuated to the second position, as represented in FIG. 5B, the polarization plate 180 is moved to the second position 502, where each of the polarizers aligns differently with the waveguides in the feed network unit. Because of these alternate alignments, different polarizations are created. This means of shifting the polarization plate 180 relative to the feed network unit to change output polarization reduces height requirements for the pillbox array 100 and allows the pillbox array to be lower in profile than other devices. Moreover, by combining subarrays of pillbox antennas, switchable independent polarization (i.e. the ability to switch polarization at each subarray) may be provided in dual aperture systems that use polarization control.

In one embodiment, for example, a separate transmit and receive pillbox array antenna may be implemented. In such cases, each pillbox subarray (e.g. 130) could incorporate its own actuated polarizer plate. Thus, each pillbox subarray would have its own separately activated polarizer plate that could move to different positions to generate different types of polarization. Using such a system, transmit and receive functions may be independently controlled, along with providing more granular control of the circular polarization coming from each pillbox subarray.

As noted above, multiple subarrays may be combined into a single pillbox array 100, including two, four, or higher numbers of subarrays. In one such embodiment, a pillbox array includes an input feed network (e.g. 132) and multiple scalable pillbox subarrays (e.g. 130, 140, 150 and 160 in FIG. 1B). At least some of the scalable pillbox subarrays are configured to receive an input wave from the input feed network (e.g. 132, 142, 152 or 162). Each pillbox subarray includes at least one pillbox reflector (e.g. 131, 141, 151 or 161) for collimating the input wave to produce a collimated wave of equal phase front. Each pillbox subarray also includes radiating waveguides (e.g. 133, 143, 153 or 163) for radiating the collimated wave.

The pillbox array may be remotely switchable. A remote switching capability would allow the pillbox array to receive a remote command (e.g. a wired or wireless signal) and switch from the first circular polarization to the second circular polarization. Thus, the pillbox array may receive such a signal indicating that polarizations are to be switched, and may initialize an actuator (e.g. 191 of FIG. 1A) which shifts the polarizer plate 180 according to the received command. The switch from one type of polarization to another may be initiated immediately, or after a specified delay.

In other cases, logic may be applied such that when a remote switch command is received, the command is only carried out if certain conditions exist, or if a certain time has been reached, or if other policy concerns have been met. Thus, a manufacturer or end user may program the pillbox array to perform a switch between polarizations according to a defined policy. This policy may, at least in some cases, be updated over the air via a wireless connection such as with an internet of things (IOT) device. In this manner, a pillbox array may be configured to function as a remotely switchable dual circular polarization array antenna.

Input waves provided to the pillbox array may be spherical wave or other types of waves. The scalable pillbox array, in addition to scaling its subarrays and feed networks, may also scale its load plate and polarizers. The load plate and its corresponding load elements may be mounted on the feed network unit 120. The polarizers are mounted to both the load elements and the scalable pillbox subarrays, creating the combined structure 195. The pillbox array 100 is scalable to include substantially any number of pillbox subarrays which, when combined, function as a single antenna unit. Moreover, the pillbox array may include substantially any number of polarizers and load elements. Thus, the scalable pillbox array may combine subarrays in a way that is easy to design and assemble, thereby saving development and manufacturing costs.

Figure 6:
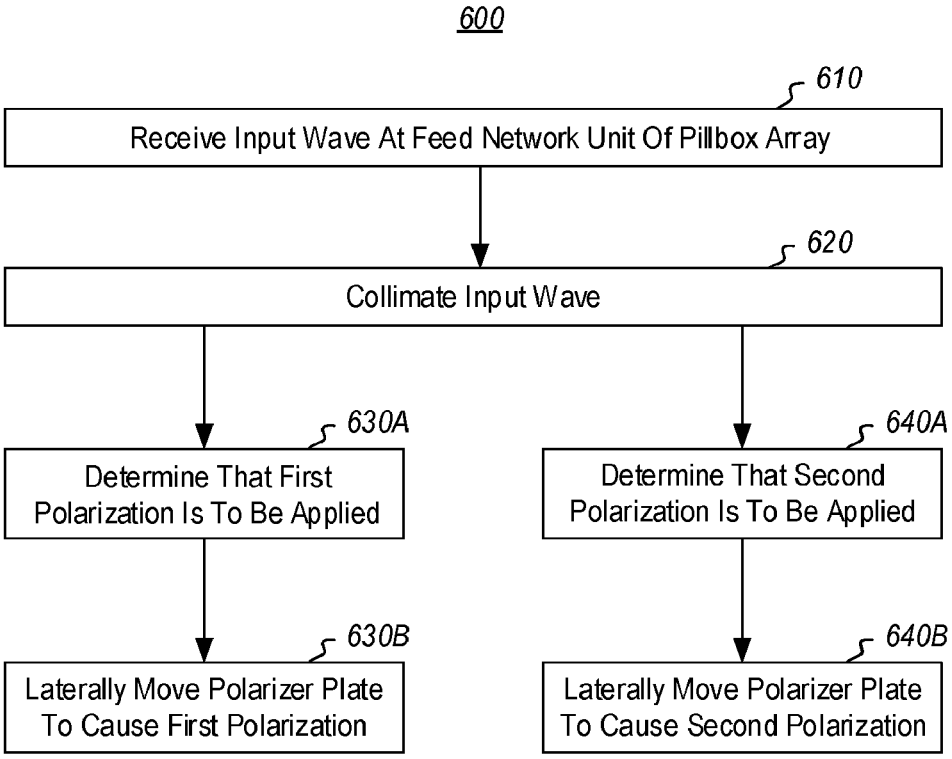
FIG. 6 illustrates a flowchart of a method for polarizing an input signal.

Turning now to FIG. 6, a method 600 is provided for polarizing a signal. The method 600 includes receiving an input wave at a feed network unit of a pillbox array (610). The feed network unit (e.g. 120 of FIG. 1B) includes feed branches (e.g. 122-127) for splitting and transmitting the input wave, pillbox reflectors (e.g. 131, 141, 151 or 161) that are configured to collimate the input wave (620), and radiating waveguides (e.g. 133, 143, 153 or 163) for radiating the collimated input wave. The method 600 further includes one of two paths: determining that a first circular polarization is to be applied to the collimated input wave (630A), and laterally moving a polarizer plate such that polarizers on the polarizer plate are moved to a first side of the radiating waveguides, causing the first circular polarization to occur (630B), or determining that a second circular polarization is to be applied to the collimated input wave (640A), and laterally moving the polarizer plate such that the polarizers on the polarizer plate are moved to a second side of the radiating waveguides, causing the second circular polarization to occur (640B).

In the method 600, the input wave may be wideband spherical wave that travels to the pillbox reflectors where the wideband spherical wave is collimated to a plane wave with a tapered amplitude and equal phase front. Collimating the spherical wave to a plane wave allows wideband array radiation patterns to be optimized in the pillbox array. Accordingly, a user who wants the pillbox array to provide a specified radiation pattern, the collimated plane wave will allow the user to modify and optimize how that radiation pattern is generated and emitted at the pillbox array's aperture. In addition to the reflectors, the feed network unit may also include a polarizing frequency selective surface (FSS). Such a polarizing FSS may radiate the polarized, collimated input wave in a manner similar to that of the waveguides. As such, the polarizing FSS may be used as an alternative to using waveguides in the pillbox array.

Thus, the embodiments described herein the array can be designed to meet a great range of antenna applications. The modularity and ease of design through the employment of a pillbox and polarizer allow the antenna to be scalable by stacking and combining subarrays to fit most needs without costly and lengthy development timelines.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A pillbox array comprising:

a feed network unit that is configured to receive an input wave, the feed network unit including:

a plurality of feed branches for splitting and transmitting the input wave;

a plurality of pillbox reflectors that are configured to collimate the input wave to thereby produce a wave of equal phase front; and a plurality of radiating waveguides for radiating the collimated input wave;

a load plate mounted on the feed network unit, the load plate including a plurality of load elements that are placed between the plurality of radiating waveguides; and a polarizer plate that is mounted on the load plate and the feed network unit, the polarizer plate including a plurality of polarizers, wherein when the polarizer plate is laterally shifted so that the plurality of polarizers are located on a first side of the plurality of radiating waveguides, a first circular polarization occurs, and wherein when the polarizer plate is laterally shifted so that the plurality of polarizers are located on a second side of the plurality of radiating waveguides, a second circular polarization occurs.

2. The pillbox array of claim 1, wherein the plurality of polarizers are step septum polarizers.

3. The pillbox array of claim 1, wherein the load elements are pyramid-shaped or triangular-shaped.

4. The pillbox array of claim 1, wherein the antenna beam is steered by tilting the pillbox array, including the feed network unit, the load plate and the polarizer plate on a mechanically gimbaled platform.

5. The pillbox array of claim 1, wherein the antenna beam is steered by moving a primary feed horn across a defined focal axis associated with the pillbox array.

6. The pillbox array of claim 1, wherein the antenna beam is steered by electronically changing feed input wave amplitudes across the feed network unit of the pillbox.

7. The pillbox array of claim 1, wherein the feed network unit is split into a plurality of feed branches that are fed into a plurality of subarray pillboxes.

8. The pillbox array of claim 7, wherein each subarray pillbox is fed by a horn that provides a wideband input wave.

9. The pillbox array of claim 1, wherein the polarizer plate performs polarization switching using mechanical actuation of one or more septum polarizers with respect to the feed network unit, such that an aperture including the plurality of radiating waveguides associated with the feed network unit is moved laterally in order to switch the polarization.

10. A pillbox array comprising:

an input feed network;

a plurality of scalable pillbox subarrays, at least some of which are configured to receive an input wave from the input feed network, the plurality of pillbox subarrays comprising the following:

at least one pillbox reflector for collimating the input wave to produce a collimated wave of equal phase front; and a plurality of radiating waveguides for radiating the collimated wave;

a plurality of load elements that are positioned between the plurality of radiating waveguides; and a plurality of polarizers mounted on the plurality of load elements, wherein when the plurality of polarizers is shifted to a first position on a first side of the plurality of radiating waveguides, the collimated wave is polarized with a first circular polarization, and wherein when the plurality of polarizers is shifted to a second position on a second side of the plurality of radiating waveguides, the collimated wave is polarized with a second circular polarization.

11. The pillbox array of claim 10, wherein the pillbox array is remotely switchable, such that upon receiving a remote command to switch from the first circular polarization to the second circular polarization, the pillbox array shifts the plurality of polarizers according to the command, such that the pillbox array is configured to function as a remotely switchable dual circular polarization array antenna.

12. The pillbox array of claim 10, wherein the input wave comprises a spherical input wave.

13. The pillbox array of claim 10, further comprising a load plate, wherein the load elements are mountable on the load plate.

14. The pillbox array of claim 10, wherein the plurality of polarizers is mounted to both the plurality of load elements and the plurality of scalable pillbox subarrays.

15. The pillbox array of claim 10, wherein the pillbox array is scalable to include a plurality of pillbox arrays which, when combined, function as a single antenna unit.

16. A method for polarizing a signal, the method comprising:

receiving an input wave at a feed network unit of a pillbox array, the feed network unit including: a plurality of feed branches for splitting and transmitting the input wave, a plurality of pillbox reflectors that are configured to collimate the input wave, and a plurality of radiating waveguides for radiating the collimated input wave; and performing at least one of the following:

determining that a first circular polarization is to be applied to the collimated input wave; and laterally moving a polarizer plate such that a plurality of polarizers on the polarizer plate are moved to a first side of the plurality of radiating waveguides, causing the first circular polarization to occur; or determining that a second circular polarization is to be applied to the collimated input wave; and laterally moving the polarizer plate such that the plurality of polarizers on the polarizer plate are moved to a second side of the plurality of radiating waveguides, causing the second circular polarization to occur.

17. The method of claim 16, wherein the input wave comprises a wideband spherical wave that travels to the plurality of pillbox reflectors where the wideband spherical wave is collimated to a plane wave with a tapered amplitude and equal phase front.

18. The method of claim 16, wherein collimating the spherical wave to a plane wave allows for optimization of wideband array radiation patterns in the pillbox array.

19. The method of claim 16, wherein the feed network unit includes a polarizing frequency selective surface (FSS).

20. The method of claim 19, wherein the polarizing FSS radiates the polarized, collimated input wave.

* * * * *